United States Patent [19]

Mahr et al.

[11] Patent Number: 4,728,240

[45] Date of Patent: Mar. 1, 1988

[54] CHARGING INSTALLATION FOR A SHAFT FURNACE

[75] Inventors: Rene Mahr, Howald; Emile Lonardi, Bascharage; Gilbert Bernard, Hemldange; Marc Solvi, Ehlange s/Mess; Pierre Mailliet, Howald, all of Luxembourg

[73] Assignee: Paul Wurth S.A., Luxembourg, Luxembourg

[21] Appl. No.: 840,386

[22] Filed: Mar. 17, 1986

[30] Foreign Application Priority Data

Mar. 15, 1985 [LU] Luxembourg ..... 85811

[51] Int. Cl.[4] ..... F23K 3/16

[52] U.S. Cl. ..... 414/21; 266/184; 414/200; 414/206

[58] Field of Search ..... 414/21, 150, 152, 157, 414/162, 167, 170–176, 193–195, 199–206, 221, 588, 300–302; 266/176, 184

[56] References Cited

U.S. PATENT DOCUMENTS

| | | | |
|---|---|---|---|
| 2,897,984 | 8/1959 | Augeard | 414/170 |
| 3,476,374 | 11/1969 | Colijn | 266/184 X |
| 3,533,523 | 10/1970 | Schneider | 414/205 X |
| 3,576,262 | 4/1971 | Konchesky et al. | 414/301 |
| 3,706,387 | 12/1972 | Tokarz | 266/184 X |
| 3,780,890 | 12/1973 | Glover | 414/170 |
| 3,796,419 | 3/1974 | Werner et al. | 414/170 |
| 3,799,369 | 3/1974 | Mahr | 414/203 |
| 3,929,240 | 12/1975 | Legille et al. | 266/176 X |
| 4,029,220 | 6/1977 | Greaves | 414/206 |
| 4,116,345 | 9/1978 | Greaves et al. | 414/205 X |
| 4,322,197 | 3/1982 | Mahr et al. | 414/206 |
| 4,497,609 | 2/1985 | Santén | 266/184 X |
| 4,514,129 | 4/1985 | Legille et al. | 414/200 |
| 4,599,028 | 7/1986 | Mahr et al. | 414/206 |

FOREIGN PATENT DOCUMENTS

| | | | |
|---|---|---|---|
| 699298 | 11/1940 | Fed. Rep. of Germany | 414/173 |

*Primary Examiner*—Joseph E. Valenza
*Assistant Examiner*—David A. Bucci
*Attorney, Agent, or Firm*—Fishman & Dionne

[57] ABSTRACT

An apparatus for distributing charge material to a shaft furnace is presented which effectively reduces the segregation of the particles in a storage housing positioned above the shaft furnace. In the present invention, the storage hopper and the distribution device are movable about the vertical axis of the shaft furnace and are mounted inside a sealed chamber. Above the chamber are arranged at least two locks which are each provided with upper and lower sealing flaps. Preferably, the storage hopper and the bottom of each of the locks are in the configuration of tapered funnels, the conical wall of which forms an angle of less than or equal to about 30° with respect to the vertical axis of the furnace. The storage hopper is preferably supported by support and guide rollers which move on a circular rail integral with the wall of the sealed chamber and is subjected to the action of a drive mechanism for rotation about the vertical axis of the furnace. Anti-segregation boxes are preferably provided both in the locks and in the hopper, to ensure better filling and guarantee a more uniform distribution of the particles of differing granulometry.

16 Claims, 5 Drawing Figures

CHARGING INSTALLATION FOR A SHAFT FURNACE

BACKGROUND OF THE INVENTION

This invention relates to a charging apparatus of a shaft furnace of the type having a rotary or oscillating chute charge distribution device and a storage housing or hopper mounted on the vertical axis of the shaft furnace. More particularly, this invention relates to a new and improved device for distributing charge material in the storage housing toward the rotary chute which selectively increases or decreases the discharge cross-section from the storage hopper symmetrically about the vertical axis of the furnace.

Patent document EP-A No. 0062770 corresponding to U.S. Pat. No. 4,514,129, assigned to the assignee hereof, all of the contents of which are incorporated herein by reference, discloses a central feed charging installation wherein the storage hopper discharges the charging material onto a chute which is arranged on the axis of the furnace. It will be appreciated that the charging installations recently constructed in accordance with the teachings of U.S. Pat. No. 4,514,129 have proven that the apparatus described therein solves the well known problems presented by oblique falls of charging material in those prior art charge installations incorporating two alternately operating storage hoppers placed next to one another.

Although the charging installation of U.S. Pat. No. 4,514,129 has made it possible to solve a problem which has been known since the existence of rotary chute charging installations, it nevertheless presents another problem discovered some time ago and attributable to the granulometry of the charging material. It will be appreciated by those skilled in the art that the charging material (which usually consists of particles of iron ore or particles of coke), has a variable and non-uniform granulometry. It has been found that during the filling of the locks and the storage hoppers, the charging material is segregated and therefore collects in configurations which are in accordance with this granulometry. Moreover, this segregation phenomenon is intensified as a result of the discharge.

The segregation results from several factors having cumulative effect. One of the reasons for the segregation is that, during the filling of a storage housing, a natural settling cone forms about the falling point. The largest and heaviest particles tend to tumble down the slopes of this cone under the influence of their own weight towards the peripheral regions of the housing. In contrast, the smallest particles (known as "smalls"), tend to remain in the central region of the settling cone.

Although a natural settling cone forms during filling, in contrast, during the discharge, an opposite phenomenon occurs. In the case of discharge, the particles in the central region tend to flow off first and penetrate to a greater extent to form a V-shaped discharge level.

In addition to this filling and discharge phenomenon, "smalls" tend to accumulate in larger proportions in the bottom of the housing. This accumulation is a result of the size of the "smalls" whereby the "smalls" will slide between the more bulky particles and thereby accumulate on the bottom of the housing.

A third phenomenon is that, when the charge material falls into a housing (especially at the start of the filling phase), a certain number of larger particles break into several parts to form "smalls" in that way.

The cumulative effect of all these phenonema is that, during the initial phase of the discharge of the charging material from the housing, the proportion of "smalls" is much higher than it is towards the end of the discharge, when the proportion of more bulky particles becomes greater. As a result, if the contents of the housing is used to deposit a layer over the entire upper charging surface of the furnace, and if a spiral or concentric circles are described for this purpose from the outside towards the center region by means of the rotary chute, the concentration of "smalls" is much higher in the peripheral regions than in the central region about the vertical axis of the furnace. Unfortunately, this arrangement or distribution of charge material does not always satisfy the requirements of the iron and steel industry.

Although the consequences of this segregation phenomenon remain within acceptable limits in installations with two alternately operating hoppers placed next to one another, they have a greater effect in high-capacity installations of the type described above, with a large central hopper having a stand-by hopper located above it.

However, because it is not desirable to significantly increase the hopper height, the capacity thereof must necessarily be increased by increasing the diameter of the hopper. It will be appreciated by one of ordinary skill in the art that an increase in the diameter intensifies the segregation effects discussed above; so that the undesired consequences thereof become more and more harmful in proportion to the increase in volume of the furnace on which the installation is mounted.

SUMMARY OF THE INVENTION

The above discussed and other problems and deficiencies of the prior art are overcome or alleviated by the charge material distribution device of the present invention. In accordance with the present invention, an apparatus for distributing charge material is provided which effectively reduces the segregation of the particles in a storage housing of a shaft furnace charging installation of the type hereinabove described.

In the present invention the storage hopper and the distribution device are movable about the vertical axis of the shaft furnace and are mounted inside a sealed chamber. Above the chamber are arranged at least two locks which are each provided with upper and lower sealing flaps. Preferably, the storage hopper and the bottom of each of the locks are in the configuration of tapered funnels, the conical wall of which forms an angle of less than or equal to about 30° with respect to the vertical axis of the furnace.

The sealed chamber preferably has three locks arranged thereabove to thereby reduce the capacity of each lock and to also ensure better charging continuity (that is, to reduce idle times as much as possible). The maximum diameter of each of the locks is preferably less than three meters.

The storage hopper is preferably supported by support and guide rollers which move on a circular rail integral with the wall of the sealed chamber and is subjected to the action of a drive mechanism for rotation about the vertical axis of the furnace.

Anti-segregation boxes are preferably provided both in the locks and in the hopper, to ensure better filling and, significantly, guarantee a more uniform distribution of the particles of differing granulometry.

The present invention consequentiy provides several effective measures making is possible to reduce segregation or its effects. Structural elements of particular importance include the small diameter of the locks and storage hopper, and the tapered configuration thereof; the rotation of the hopper about the vertical axis; and the anti-segregation boxes.

The above discussed and other features and advantages of the present invention will be appreciated and understood by those skilled in the art from the followind detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figures 1, 1A:
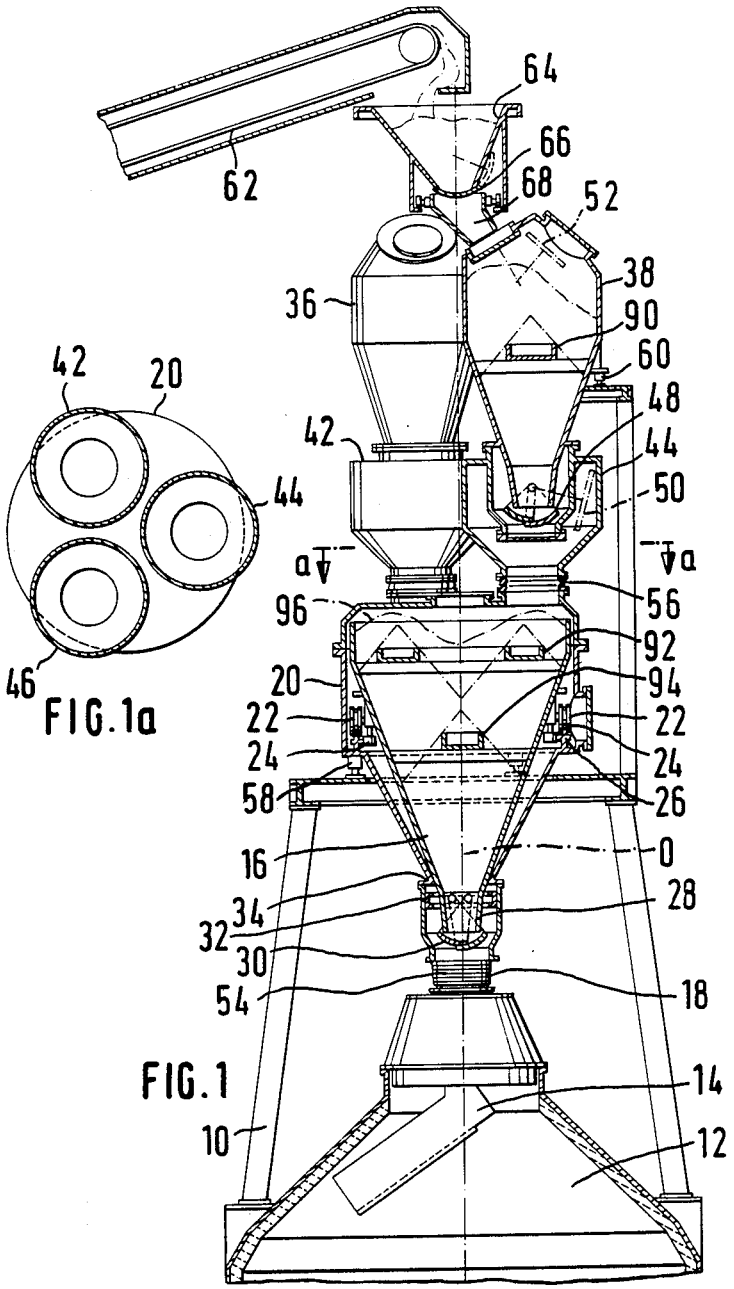
FIG. 1 is a diagrammatic side elevation view of a charging installation in accordance with a first embodiment of the present invention.
FIG. 1*a* is a cross-sectional elevation view along the sectional plane a—a of FIG. 1.
Figure 2:
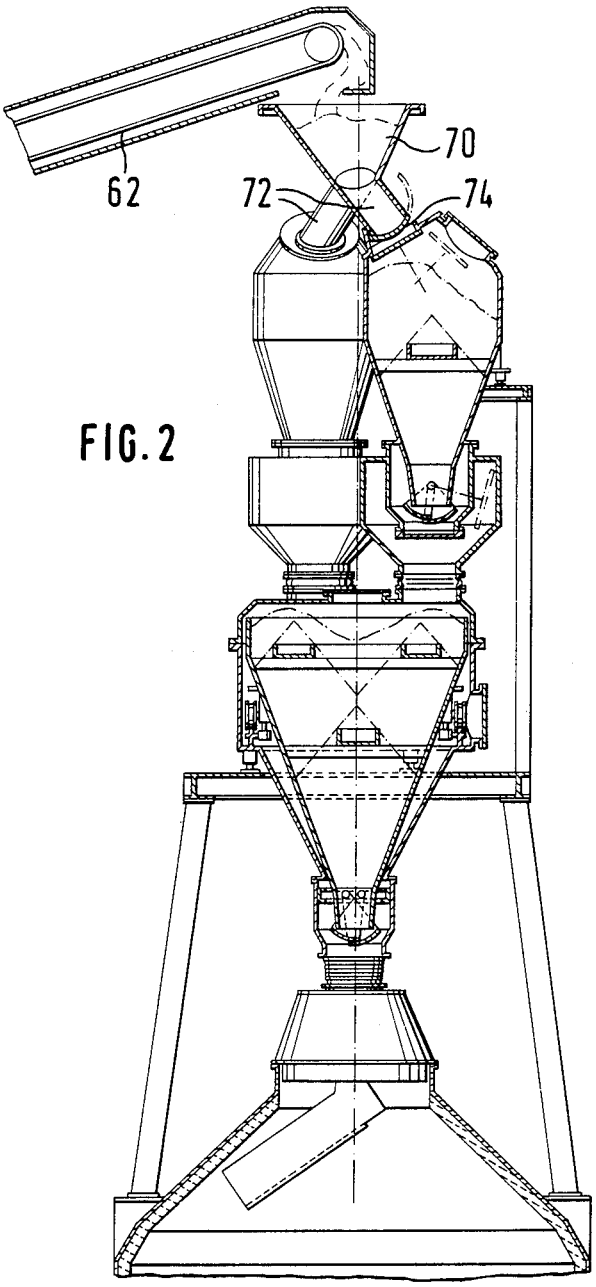
FIG. 2 is a diagrammatic side elevation view of a charging installation in accordance with a second embodiment of the present invention.
Figure 3:
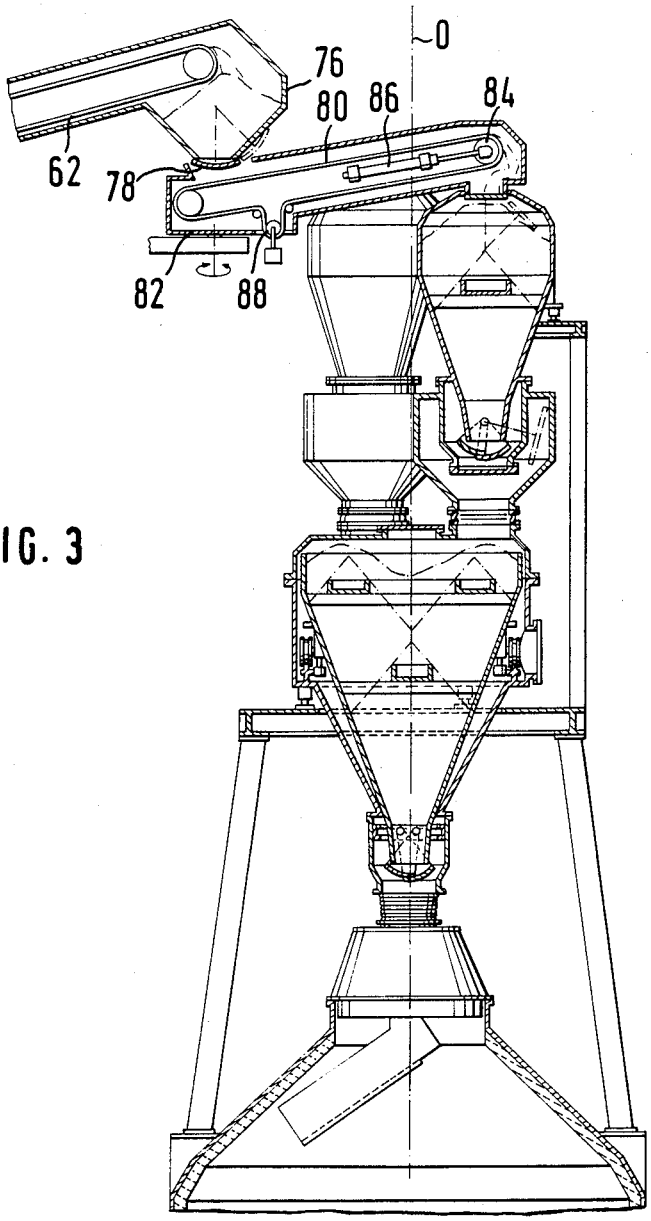
FIG. 3 is a diagrammatic side elevation view of a charging installation in accordance with a third embodiment of the present invention.

FIGS. 1–3 illustrate generally similar charging installations wherein the top portion of a furnace is shown at 12 having a rotary or oscillating chute 14 for distributing the charge material into the furnace 12. Mounted on the furnace is a frame 10 which supports a storage hopper or housing 16 which is arranged symmetrically about the central longitudinal axis 0 of furnace 12 above a vertical feed channel 18 opening onto chute 14. In accordance with a particularly important feature of the present invention, hopper 16 has the configuration of a tapered funnel, the conical wall of which preferably forms an angle of less than or equal to about 30° with respect to the axis 0 and the maximum diameter of which does not exceed four (4) to five (5) meters in its upper portion.

Storage hopper 16 is enclosed by a sealed chamber 20 supported by frame 10. In accordance with another particularly important feature of the present invention, hopper 16 is adapted to rotate within sealed chamber 20 about the vertical axis 0. For this purpose, hopper 16 is provided with several (for example four) running rollers 22 which move along a circular rail 26 and an inner shoulder of chamber 20. Other rollers 24 with vertical axes of rotation ensure horizontal retention and move on an inner rim of rail 26.

Hopper 16 extends downwardly in the form of a discharge neck 28 provided with a dispensing flap 30 for regulating the discharge of the charging material from hopper 16 onto chute 14. Flap 30 is of the type disclosed in U.S. Pat. No. 4,514,129 and comprises two registers, preferably having a cup-shape, which open and close in synchronism and in opposite directions relative to axis 0 so as to define a symmetrical discharge orifice about the axis 0. These registers can be actuated in a known manner by means of an annular rail 32 which can be raised and lowered from outside; and in which move guide rollers mounted on arms of each of the registers. This allows the flap to be actuated during the rotation of the hopper 16 as a result of the vertical displacement of the rail 32.

To prevent excessive penetration of hot gases into chamber 20 (from shaft furnace 12), the bottom of the chamber is also funnel-shaped, so as to form, above the neck 28, as narrow a throttle 34 as possible between the wall of the chamber 20 and that of the hopper 16. Preferably, this throttle 34 is equipped with a rubbing strip to prevent (to the greatest extent possible) the passage of gases. As an alternative solution, a pressurized inert gas can be delivered or injected into chamber 20 to generate, via the throttle 34, a counter-flow downdraft which prevents the gases from rising.

In the illustrated example, chamber 20 has located above it a triangular arrangement of three individual locks 36, 38 and 40 (lock 40 not being visible in the Figure) supported individually by frame 10. Each of locks 36, 38 and 40 and hopper 16 communicate respectively with one another via flap housings 42, 44 and 46 (see FIG. 1*a*) which each contain a dispensing flap 48 and a sealing flap 50. Like flap 30, dispensing flap 48 also preferably comprises two spherical registers which pivot as a result of a symmetrical action about the vertical axis of each lock. This flap 48 and the lower neck of the locks with which it interacts, are preferably as wide as possible, to ensure a rapid flow-off from the locks towards the interior of hopper 16.

Each of locks 36, 38 and 40 must also be equipped with an upper sealing flap 52, to allow the locks to be pressurized during the discharge of the charge material towards the hopper and subsequent ventilation during charging. A sealed compensator 54 is located between chamber 20 and the head of furnace 12. Similarly, sealed compensators 56 are located between chamber 20 and each of the flap housings 42, 44, and 46. Compensators 54 and 56 permit individual weighing of chamber 20, hopper 16 and each of the locks 36, 38 and 40. Weighing is carried out, in a known method, by means of strain gauges shown diagrammmatically at 58 and 60 and carrying, the chamber 20 and each of the locks 36, 38 and 40, respectively. By virtue of these individual weighing operations, the content of hopper 16 and that of each of the locks 36, 38 and 40 can be determined; to thereby automatically control the opening of the flaps for filling and emptying these reservoirs.

The furnace charging material is delivered by means of a conveyor belt 62 which, in the embodiment of FIG. 1, conveys the material into a stand-by hopper 64, the discharge of which is controlled by a flap 66. Located underneath hopper 64 is a rotary chute 68 which successively makes the connection between the hopper 64 and each of the locks 36, 38 and 40.

In the embodiment of the present invention shown in FIG. 2, conveyor belt 62 also conveys the charging material into a stand-by hopper 70. In this embodiment, the chute of FIG. 1 is replaced by three fixed pipes 72 connecting hopper 70 to each of the locks 36, 38 and 40. In the illustrated example, each of the pipes is connected to a closing and opening flap 74. However, instead of providing three flaps, it will be appreciated that a single flap at the intersection of the branch pipes 72 and the hopper 70 may be provided. This arrangement also allows pipes 72 to be completely emptied.

In the alternative embodiment shown in FIG. 3, the conveyor belt 62 also delivers the charging materials into a stand-by hopper 76, the discharge orifice of which is controlled by a flap 78. From hopper 76, the charging material falls onto a second conveyor belt 80 which is mounted in a frame 82 capable of pivoting about an axis parallel to the central vertical axis 0. This second conveyor belt 80 is also retractable, and for this purpose, the front deflecting roller 84 can slide longitudinally under the action of a jack 86; the length of the conveyor belt being compensated by means of a free idling roller 88. In this way, conveyor belt 80 can convey the charging material into each of the locks 36, 38 and 40.

As mentioned hereinabove, the primary object of the present invention is to eliminate charge material segregation or at least reduce its effects. One of the factors contributing to achieving this object is the replacement of the single large-capacity hopper disclosed in U.S. Pat. No. 4,514,129 by four small-diameter housings. For example, in a preferred embodiment, the capacity of each of the locks 36, 38 and 40 and that of the hopper 16 is only 20 $m^3$, as against 80 $m^3$ in the above-mentioned patent. Furthermore, each of the locks and the hopper 16 have a highly tapered form, the angle between their conical wall and the vertical axis preferably not exceeding 30°. It will be appreciated by one skilled in the art that it would be ideal to have straightforward tubular housings, the cross-section of which are equal to the cross-section of the discharge pipe. However, in practice, this is difficult to carry out because of the resulting increase in height. It is therefore necessary to find a compromise (i.e., tapered configuration) between the available height and the cross-section of the locks and of the storage hopper.

Referring again to FIGS. 1–3, a well known anti-segregation box 90 has been fitted in each of the locks 36, 38 and 40. Such a box reduces segregation during filling and assists in a more uniform discharge during emptying. Similarly, a central anti-segregation box 94 and, in addition, an upper annular box 92 are also provided in hopper 16. These boxes reduce the rolling of the particles and contribute to urging the "smalls" against the hopper wall, whereas without the presence of these boxes, the "smalls" against the hopper wall would tend to accumulate along the axis 0.

The rotation of hopper 16 also reduces charge material segregation to a certain extent. However, the essential aim of this rotation is to ensure that hopper 16 is filled correctly. This rotation, which preferably takes place at a speed of 6 or 8 revolutions per minute, permits the contents of a lock to be deposited in the hopper 16 according to the charging line 96, with only a slight depression in the central region.

A process for charging a furnace by means of an installation with three locks, each of 20 $m^3$, and a hopper of 30 $m^3$ will now be described as an example of the present invention.

Figure 4:
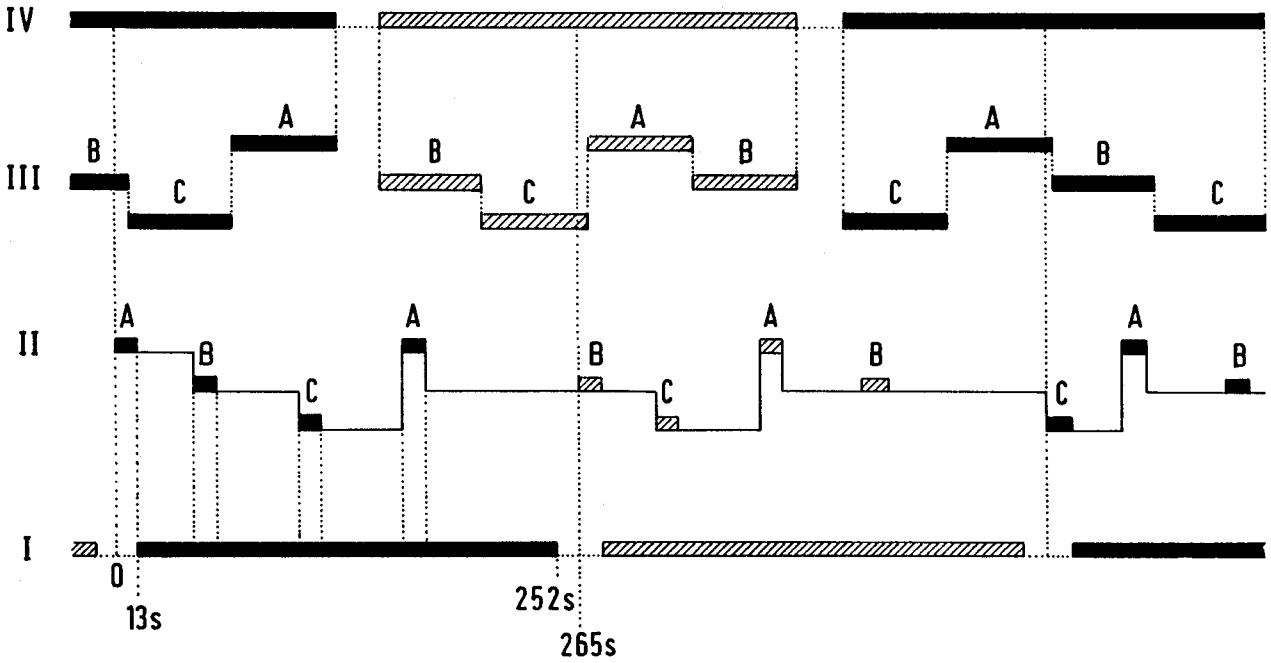
FIG. 4 is a timing diagram showing the several charging operations in accordance with the present invention.

The initial data are as follows:

Production capacity: 10,000 tonnes of cast iron/day
Safety factor: 1.3
Maximum capacity: $1.3\times10{,}000=13{,}000$ tonnes of cast iron/day
Diameter of the furnace: 10 m
Thickness of a charging layer: 1 m
Volume of a charging layer: $\pi 5^2\times1=80$ $m^3$volume of 4 locks
Number of charging cycles per day: $13{,}000/80=163$
Number of cycles for successive and alternating layers of coke and ore: $163\times2=236$
Available time for each cycle: $24\times60\times60/326=265$ s
Time required to open and close the flap 30: $2\times13=26$s
Actual time available for each cycle: $265-26=239$ s
Delivery rate regulated by means of the flap 30:$80/239s=0.335$ $m^3/s$ The charging diagram of FIG. 4 is actually four (4) superimposed graphs on the same time base. Graph I shows the successive phases, each lasting 265 seconds, of alternating coke and ore charging operations. Graph II represents the emptying of the three locks which are no longer designated by their reference numerals 36, 38 and 40, but by the letters A, B and C for the sake of convenience. Graph III represents the charging of the three locks A, B and C, while Graph IV represents the supply of coke and ore by means of the conveyor 62.

The first 13 seconds are reserved for opening the dispensing flaps 30 towards a position corresponding to a delivery rate of 0.335$m^3$ of charging material per second. At the starting time $t=0$, the sealing and dispersing flaps of the lock A are open, and during these 13 seconds the content of this lock A is transferred completely into the hopper 16 (see Graph II). During this time, the filling of the lock B ends and the filling of the lock C begins (see Graph III); while the provision of a continuous layer of 80 $m^3$ by the conveyor belt (see Graph IV) continues. In the example illustrated, it has been assumed, by way of example, that a layer of coke is first deposited, this being indicated by the thick black line.

After 13 seconds, the discharge of coke onto the distribution chute starts at a rate of 0.335 $m^3$ per second. The lock A, which is now emptied of its content, can be prepared for the next filling. For this purpose its lower dispensing flap and sealing flap are closed and it is ventilated. When the continuous weighing of the chamber 20 and the hopper 16 indicates that the contents of the latter has fallen to a certain level, the content of lock B is transferred to hopper 16; likewise in 13 seconds, while the discharge from the latter continues. The filling of lock C, which also continues, reaches its conclusion, and as soon as the latter is filled, the lock A, the upper sealing flap of which has just been opened, now receives the last 20 $m^3$ of coke from the conveyor belt.

During the filling of lock A, lock C is pressurized, and as soon as the level of the hopper 16 has fallen sufficiently low, the content of lock C is transferred into the hopper. When lock A is filled, it is similarly pressurized in order to transfer its content into hopper 16. When this has been done, the contents of lock A will have been emptied into the hopper twice and the contents of each of the locks B and C will have been emptied into the hopper once, that is $4\times20=80$ $m^3$. After 252 seconds, these 80 $m^3$ of coke are deposited in a uniform layer of one meter, in concentric circles from the outside towards the center of the charging surface. After these 252 seconds, flap 30 of hopper 16 is closed to prepare for the ore charging cycle.

In fact, this ore charging cycle has already started at an upper level, with conveyor 62 bringing up a layer of 80 $m^3$ of ore and with the filling of locks B and C.

At the end of the first cycle, that is, after 265 seconds, for 13 seconds the ore content of lock B is transferred towards hopper 16; and at the same time, the opening of the dispensing flaps is set to a discharge position corresponding to a delivery rate of 0.335 $m^3$ per second. During the emptying of lock B, the operation of filling lock C ends and the filling of lock A with ore begins. Charging with ore starts after 13 seconds of the second cycle. This charging is similar to the charging with coke, that is, contents of the B-C, A and B are emptied in succession, each time the weighing of the hopper 16 requests such action.

FIG. 4 shows yet another advantage of the present invention relative to the prior art apparatus disclosed in U.S. Pat. No. 4,514,129. In fact, as Graph I shows, charging is virtually continuous, the only interruption being the stop of 20 seconds between each cycle for actuating the flap of the hopper. In any event, it is scarcely possible to carry out 100% continuous charging, because, after each layer has been deposited, it is necessary to stop charging in order to raise the chute and start a new layer on the periphery.

The present invention thus effectively reduces the segregation of the particles in the intermediate storage housing of a shaft furnace charging apparatus of the type described in FIG. 1 and U.S. Pat. No. 4,514,129 as well as providing several additional important features, advantages and improvements over the apparatus of U.S. Pat. No. 4,514,129.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A charging installation for a shaft furnace, the furnace having an axis, the furnace further having a charge material supply opening which is coaxial with said axis, said furnace also having a rotary or oscillating chute for distributing charge material from the charge material supply opening into the furnace, said charging installation comprising:

an intermediate charge material storage vessel, said vessel having an axis, said vessel further having an upper end and a lower end with a discharge opening at its lower end, said discharge opening being coaxial with said vessel axis;

means for coupling said vessel discharge opening to the furnace to selectively establish a flow of charge material from said vessel to the rotary or oscillating chute, said coupling means including flow control means, said flow control means defining a variable area orifice which is generally symmetrical with respect to a prolongation of the furnace axis;

means for rotating said intermediate storage vessel and said flow control means about said vessel axis;

sealed chamber means, said sealed chamber means enclosing said intermediate storage vessel, said sealed chamber means having a lower end associated with said lower end of said intermediate storage vessel and an upper end associated with said upper end of said intermediate storage vessel, said upper end of said sealed chamber means including a plurality of loading openings, said loading openings communicating with said upper end of said intermediate storage vessel;

at least two lock means, each lock means having an upper and lower sealing means for entry and exit of charge material, said lock means being positioned above said upper end of said sealed chamber means and each of said lower sealing means selectively communicating with one of said loading openings of said sealed chamber means.

2. The installation of claim 1 wherein:

said lower end of said intermediate storage vessel and the lower portion of said lock means have a downwardly tapering configuration.

3. The installation of claim 2 wherein:

said tapering configuration of said lower end of said intermediate storage vessel and the lower portion of said lock means each forms an angle of less than about 30 degrees with respect to the furnace axis.

4. The installation of claim 1 including:

three lock means communicating with said intermediate storage chamber.

5. The installation of claim 1 wherein said storage vessel and said lock means have a preselected diameter and wherein:

said preselected diameter is less than or equal to about three meters.

6. The instalation of claim 1 wherein said chamber means has an interior wall and wherein said means for rotating said intermediate storage vessel and flow control means includes:

rail means attached along the circumference of said interior wall of said chamber means;

support and guide rollers attached to said storage vessel and communicating with said rail means.

7. The installation of claim 1 including:

first anti-segregation box means being positioned in about the center of at least one of said lock means.

8. The installation of claim 1 including:

second anti-segregation box means being positioned in about the center of said storage vessel.

9. The installation of claim 8 including:

third anti-segregation box means being positioned within the upper end of said storage vessel, said third box means having an annular configuration and being disposed underneath said loading openings of said storage vessel.

10. The installation of claim 1 wherein:

said lower sealing means of each lock means comprises a flap housing comprising a dispensing flap and a sealing flap.

11. The installation of claim 10 including:

first compensator means being positioned between each of said flap housings and said sealed chamber means;

second compensator means being positioned between the shaft furnace and said sealed chamber means;

means for individually weighing each lock means; and means for weighing said sealed chamber means and storage vessel.

12. The installation of claim 11 wherein:

said weighing means comprises strain gauge means with said lock means and said sealed chamber means resting on said strain gauge means.

13. The installation of claim 1 including:

stand-by hopper means;

a second rotary chute, said second rotary chute selectively communicating between said stand-by hopper means and each of said lock means for delivery of charge material to each lock means.

14. The installation of claim 1 including:

stand-by hopper means;

at least two fixed discharge pipes, each of said discharge pipes communicating between said stand-by hopper means and one of said lock means for delivery of charge material to each lock means.

15. The installation of claim 1 including:

retractable conveyer belt means mounted on support means, said support means capable of pivoting about an axis parallel to said furnace axis for conveying charge material into each of said lock means.

16. The installation of claim 15 wherein said conveyer belt means includes:

an endless belt;

a front and back roller, said belt being driven by said rollers; and jack means, said jack means actuating said front roller to urge said front roller along the longitudinal direction of said endless belt.

* * * * *